US008805262B2

(12) United States Patent
McGuire et al.

(10) Patent No.: US 8,805,262 B2
(45) Date of Patent: Aug. 12, 2014

(54) APPARATUS AND METHODS FOR DELIVERY OF A FUNCTIONAL MATERIAL TO AN IMAGE FORMING MEMBER

(75) Inventors: Gregory McGuire, Oakville (CA); Yu Liu, Mississauga (CA); Sarah J. Vella, Windsor (CA); Vladislav Skorokhod, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 223 days.

(21) Appl. No.: 13/286,905

(22) Filed: Nov. 1, 2011

(65) Prior Publication Data

US 2013/0108312 A1 May 2, 2013

(51) Int. Cl.
*G03G 21/00* (2006.01)
*G03G 15/01* (2006.01)

(52) U.S. Cl.
CPC ..... *G03G 21/00* (2013.01); *G03G 15/0189* (2013.01); *G03G 21/0094* (2013.01)
USPC ..... 399/346; 399/302

(58) Field of Classification Search
CPC G03G 15/0189; G03G 21/00; G03G 21/0094
USPC ..... 399/346
See application file for complete search history.

(56) References Cited

U.S. PATENT DOCUMENTS 3,950,833 A * 4/1976 Adams ..... 492/53
4,387,980 A 6/1983 Ueno
5,215,839 A 6/1993 Yu
5,469,247 A * 11/1995 Cheng et al. ..... 399/350
5,482,552 A * 1/1996 Kikukawa et al. ..... 118/264
5,510,886 A * 4/1996 Sugimoto et al. ..... 399/308
5,660,961 A 8/1997 Yu
5,958,638 A 9/1999 Katayama
6,060,205 A * 5/2000 Takeichi et al. ..... 430/126.2
6,160,977 A * 12/2000 Takeichi et al. ..... 399/127
6,434,357 B1 * 8/2002 Maul et al. ..... 399/325
7,580,655 B2 8/2009 Nukada
2001/0031411 A1 * 10/2001 Kojima et al. ..... 430/58.05
2006/0165450 A1 * 7/2006 Koike et al. ..... 399/346
2007/0059067 A1 * 3/2007 Tanaka et al. ..... 399/346
2008/0107463 A1 * 5/2008 Ferrar et al. ..... 399/400
2009/0169236 A1 * 7/2009 Fukao et al. ..... 399/99

OTHER PUBLICATIONS

U.S. Appl. No. 13/192,215, filed Jul. 27, 2011 to Hu, et al.
U.S. Appl. No. 13/192,252, filed Jul. 27, 2011 to Vella, et al.

* cited by examiner

*Primary Examiner* — Benjamin Schmitt
(74) *Attorney, Agent, or Firm* — Pillsbury Winthrop Shaw Pittman LLP

(57) ABSTRACT

The presently disclosed embodiments relate generally to an image forming apparatus including a delivery member for delivering a functional material in contact with an intermediate transfer belt such that functional material is transferred onto one or more imaging members via the intermediate transfer belt. Embodiments also pertain to an improved electrophotographic imaging member comprising a very thin outer layer on the imaging member surface, where the outer layer comprises functional materials, such as paraffin, that act as a lubricant and or a barrier against moisture and/or surface contaminants. The improved imaging member exhibits improved xerographic performance, such as reduced friction and deletions in high humidity conditions.

19 Claims, 4 Drawing Sheets

APPARATUS AND METHODS FOR DELIVERY OF A FUNCTIONAL MATERIAL TO AN IMAGE FORMING MEMBER

BACKGROUND

The presently disclosed embodiments relate generally to layers that are useful in imaging apparatus members and components, for use in electrophotographic, including digital printing, apparatuses. More particularly, the embodiments pertain to an improved electrophotographic imaging member comprising a very thin outer layer on the imaging member surface, where the outer layer comprises functional materials that act as a lubricant and or a barrier against moisture and/or surface contaminants to address high torque and image quality such as A-zone deletion. The very thin outer layer is applied to the imaging member on a Nan-scale or molecular level. The improved imaging member exhibits improved xerographic performance, such as improved interaction with blade cleaner and reduced image deletions in high humidity conditions. The embodiments also pertain to methods and systems for delivering the functional materials to the surface of the imaging member.

In electro photography or electrophotographic printing, the charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable powder known as toner. Toner is held on the image areas by the electrostatic charge on the photoreceptor surface. Thus, a toner image is produced in conformity with a light image of the original being reproduced or printed. The toner image may then be transferred to a substrate or support member (e.g., paper) directly or through the use of an intermediate transfer member, and the image affixed thereto to form a permanent record of the image to be reproduced or printed. Subsequent to development, excess toner left on the charge retentive surface is cleaned from the surface. The process is useful for light lens copying from an original or printing electronically generated or stored originals such as with a raster output scanner (ROS), where a charged surface may be imagewise discharged in a variety of ways.

The described electrophotographic copying process is well known and is commonly used for light lens copying of an original document. Analogous processes also exist in other electrophotographic printing applications such as, for example, digital laser printing and reproduction where charge is deposited on a charge retentive surface in response to electronically generated or stored images.

To charge the surface of a photoreceptor, a contact type charging device has been used, such as disclosed in U.S. Pat. No. 4,387,980 and U.S. Pat. No. 7,580,655, which are incorporated herein by reference. The contact type charging device, also termed "bias charge roll" (BCR) includes a conductive member which is supplied a voltage from a power source with a D.C. Voltage superimposed with an AC. Voltage of no less than twice the level of the D.C. Voltage. The charging device contacts the image bearing member (photoreceptor) surface, which is a member to be charged. The outer surface of the image bearing member is charged at the contact area. The contact type charging device charges the image bearing member to a predetermined potential.

Electrophotographic photoreceptors can be provided in a number of forms. For example, the photoreceptors can be a homogeneous layer of a single material, such as vitreous selenium, or it can be a composite layer containing a photoconductive layer and another material. In addition, the photoreceptor can be layered. Multilayered photoreceptors or imaging members have at least two layers, and may include a substrate, a conductive layer, an optional undercoat layer (sometimes referred to as a "charge blocking layer" or "hole blocking layer"), an optional adhesive layer, a photo generating layer (sometimes referred to as a "charge generation layer," "charge generating layer," or "charge generator layer"), a charge transport layer, and an optional overcoating layer in either a flexible belt form or a rigid drum configuration. In the multilayer configuration, the active layers of the photoreceptor are the charge generation layer (CGL) and the charge transport layer (CTL). Enhancement of charge transport across these layers provides better photoreceptor performance. Multilayered flexible photoreceptor members may include an anti-curl layer on the backside of the substrate, opposite to the side of the electrically active layers, to render the desired photoreceptor flatness.

Conventional photoreceptors are disclosed in the following patents, a number of which describe the presence of light scattering particles in the undercoat layers: Yu, U.S. Pat. No. 5,660,961; Yu, U.S. Pat. No. 5,215,839; and Katayama et al., U.S. Pat. No. 5,958,638. The term "photoreceptor" or "photoconductor" is generally used interchangeably with the terms "imaging member." The term "electrophotographic" includes "electrophotographic" and "xerographic." The terms "charge transport molecule" are generally used interchangeably with the terms "hole transport molecule."

To further increase the service life of the photoreceptor, use of overcoat layers has also been implemented to protect photoreceptors and improve performance, such as wear resistance. However, these low wear overcoats are associated with poor image quality due to A-zone deletion (i.e. an image defect occurred in A-zone: 28° C., 85% RH) in a humid environment as the wear rates decrease to a certain level. For example, most organic photoconductor (OPC) materials sets require a certain level of wear rate in order to suppress A-zone deletion, thus limiting the life of a photoreceptor. In addition, high torque associated with low wear overcoats in A-zone also causes severe issues, such as motor failure and blade damage.

SUMMARY

According to aspects illustrated herein, there is provided an image forming apparatus comprising: a) one or more imaging members comprising a support substrate, and one or more photoconductive layers disposed on the substrate; b) an intermediate transfer belt disposed in contact with the surface of the one or more imaging members; and c) a delivery unit disposed in contact with a surface of the intermediate transfer belt, wherein the delivery unit applies a layer of functional material to the surface of the intermediate transfer belt and the intermediate transfer belt in turn applies a layer of the functional material onto the surface of the one or more imaging members.

In another embodiment, there is provided an image forming apparatus comprising: a) one or more imaging members comprising a support substrate, and one or more photoconductive layers disposed on the substrate; b) an intermediate transfer belt disposed in contact with the surface of the one or more imaging members; c) an intermediate transfer belt cleaning unit disposed in contact with the surface of the intermediate transfer belt; and d) a delivery unit disposed in contact with a surface of the intermediate transfer belt downstream from the intermediate transfer belt cleaning unit, wherein the delivery unit applies a layer of functional material to the surface of the intermediate transfer belt and the intermediate transfer belt in turn applies a layer of the functional material onto the surface of the one or more imaging members.

In yet further embodiments, there is provided A method for reducing printing defects in an image forming apparatus comprising: providing a delivery unit containing functional material in an image forming apparatus, the image forming apparatus comprising a) one or more imaging members comprising a support substrate, and one or more photoconductive layers disposed on the substrate; b) an intermediate transfer belt disposed in contact with the surface of the one or more imaging members, and c) the delivery unit disposed in contact with a surface of the intermediate transfer belt; contacting the intermediate transfer belt with the delivery unit to apply a layer of the functional material to the surface of the intermediate transfer belt; and contacting the one or more imaging members with the intermediate transfer belt to deliver the functional material to the surface of the one or more imaging members.

BRIEF DESCRIPTION OF THE DRAWINGS

For a better understanding, reference may be made to the accompanying figures.

DETAILED DESCRIPTION

Figure 1:
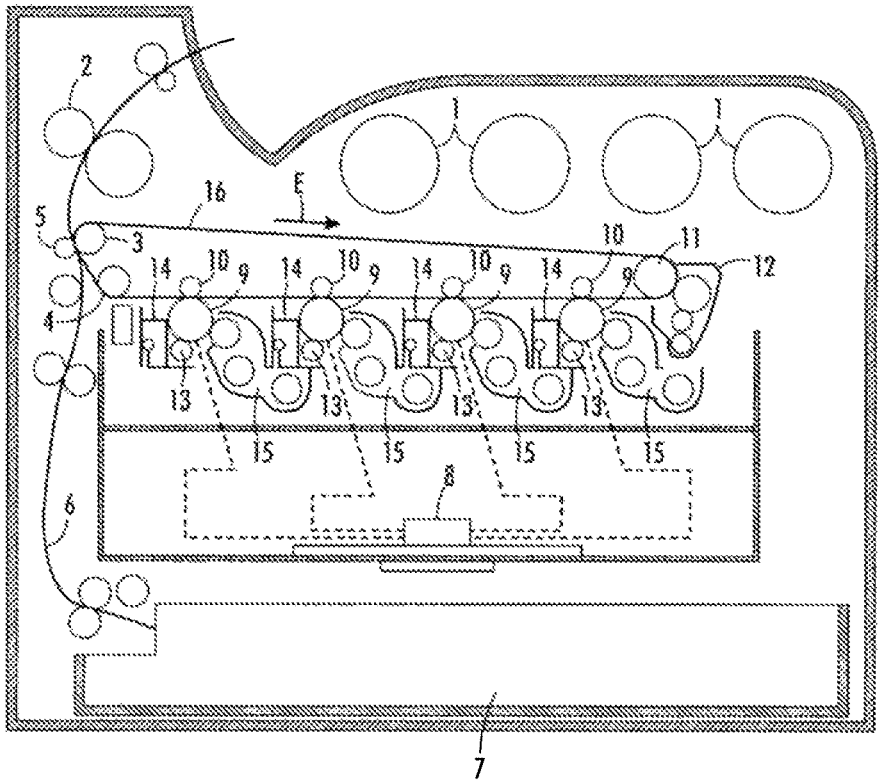
FIG. 1 is a schematic view showing one example of an image forming apparatus according to the present embodiments.

In the following description, reference is made to the accompanying drawings, which form a part hereof and which illustrate several embodiments. It is understood that other embodiments may be used and structural and operational changes may be made without departure from the scope of the present disclosure.

To overcome the limitations associated with overcoat layers, as discussed above, the disclosed embodiments are directed generally to an improved electrophotographic imaging member comprising a very thin outer layer on the imaging member surface that comprises functional materials that act as a lubricant and or a barrier against moisture and/or surface contaminants. The outer layer imparts improved xerographic performance to imaging members incorporating such an outer layer, such as improved wear resistance, low friction, and reduced image defects due to deletion in high humidity conditions. Such embodiments are disclosed in commonly owned and co-pending U.S. patent application Ser. No. 13/192,252 to Vella et al. and commonly owned and co-pending U.S. patent application Ser. No. 13/192,215 to Hu et al., the entire disclosures of which are incorporated herein by reference in their entirety. Such embodiments, however, are limited by the supply of functional material available due to the smaller size of the delivery member used inside the customer replaceable unit (CRU). Moreover, the configurations provided in these previous embodiments require a separate delivery unit or member for delivering the functional materials within each CRU, thus requiring more complicated modifications to existing systems and increasing costs.

Thus, the present embodiments provide improved methods and image forming apparatuses for delivering the functional materials to the outer layer of an imaging surface. As used herein, "functional material" is a material that provides maintenance of desired photoreceptor function. For example, the functional material may be one that is continuously applied onto the photoreceptor surface through direct contact transfer and which can maintain the desired function(s) of the photoreceptor by providing continued lubrication and surface protection. Lubrication of the photoreceptor surface improves interaction with other components in a xerographic system, such as for example, the blade cleaner to reduce torque and blade damage. By maintaining a thin layer of surface material on the photoreceptor, the functional material also provides surface protection to prevent image deletion in, for example, a humid environment such as A-zone.

In the present embodiments, the outer layer of functional materials on the imaging member surface is maintained by implementing a specific configuration in the image forming apparatus. In these embodiments, the image forming apparatus comprises: a) one or more imaging members comprising: a support substrate, and one or more photoconductive layers disposed on the substrate; b) an intermediate transfer belt disposed in contact with the surface of the one or more imaging members; and c) a delivery member disposed in contact with a surface of the intermediate transfer belt, wherein the delivery member applies a layer of functional material to the surface of the intermediate transfer belt and the intermediate transfer belt in turn applies a layer of the functional material onto the surface of the one or more imaging members. In this manner, the imaging member life is extended with a low cost solution in which lithe modification is needed to the image forming apparatus. By delivering the functional materials through the intermediate transfer belt, only one delivery member is needed rather than a separate delivery member for each CRU. Moreover, the delivery member is not limited in size due to its location and can thus include a much larger supply of functional materials, even in amount sufficient for the life of the apparatus.

The exemplary embodiments of this disclosure are described below with reference to the drawings. The specific terms are used in the following description for clarity, selected for illustration in the drawings and not to define or limit the scope of the disclosure. The same reference numerals are used to identify the same structure in different figures unless specified otherwise. The structures in the figures are not drawn according to their relative proportions and the drawings should not be interpreted as limiting the disclosure in size, relative size, or location.

The image forming apparatus of the present embodiments is not particularly limited insofar as it belongs to an intermediate transfer body format, that is, an image forming apparatus having a structure provided with at least a first transfer means(/apparatus) for primarily transferring a toner image formed on an image bearing body onto an intermediate transfer belt, and a second transfer means(/apparatus) for secondarily transferring a toner image transferred on the intermediate transfer belt, onto a transfer body. Examples of the image forming apparatus of the present embodiments include a normal monocolor image forming apparatus in which only single color toners are accommodated in a developing device, a color image forming apparatus in which successive primary transfer of a toner image held on an image bearing body onto an intermediate transfer body is repeated, and a tandem-type color image forming apparatus in which a plurality of image bearing bodies provided with developing equipment for every color are arranged on an intermediate transfer body in series.

In addition, according to known methods, the image forming apparatus of the present embodiments may be optionally provided with an image bearing body, an electrification means for electrifying an image bearing body surface, an exposing means for exposing an image bearing body surface to the light to form an electrostatic latent image, a developing means for developing a latent image formed on an image bearing body surface using a developer to form a toner image, a means for fixing a toner image on a transfer body, a cleaning means for removing a toner and refuse attached to an image bearing body, and a discharging means for removing an electrostatic latent image remaining on an image bearing body surface, if necessary.

A specific embodiment of a tandem-type color image forming apparatus will be explained below using the drawings.

FIG. 1 is a schematic view showing one example of the image forming apparatus of the present embodiments. The image forming apparatus showed in FIG. 1 contains, as principal constituent members, four toner cartridges 1, one pair of fixing rolls 2, a back-up roll 3, a tension roll 4, a secondary transfer roll (secondary transfer means) 5, a paper path 6, a paper tray 7, a laser-generating device 8, four photoreceptors (image members) 9, four primary transfer rolls (primary transfer means) 10, a driving roll 11, a transfer cleaner 12, four electrification rolls 13, a photoreceptor cleaner 14, a developing device 15, and an intermediate transfer belt 16. In the image forming apparatus shown in FIG. 1, an intermediate transfer belt of the present embodiments is used as an intermediate transfer belt 16 which functions as a means for overlaying toner images, and a means for transferring a toner image.

Next, construction of an image forming apparatus as shown in FIG. 1 will be explained in stages. First, an electrification roll 13, a developing device 15, a primary transfer roll 10 disposed via an intermediate transfer belt 16, and a photoreceptor cleaner 14 are arranged counterclockwisely around a photoreceptor 9, and one set of these members form a developing unit corresponding to one color. In addition, each of these developing units is provided with a toner cartridge 1 for replenishing developer to each developing device 15, and a laser-generating device 8 which can irradiate laser light to a surface of the photoreceptor 9 between the electrifying roll 13 and the developing device 15 according to image information is provided relative to the photoreceptor 9 of each developing unit.

Four developing units corresponding to four colors (e.g. cyan, magenta, yellow, and black) are arranged in series in an approximately horizontal direction in an image forming apparatus, and an intermediate transfer belt 16 is provided so as to pass through a nip part between the photoreceptor 9 and the primary transfer roll 10 of each of the four developing units. The intermediate transfer belt 16 is stretched by a back-up roll 3, a tension roll 4, and a driving roll 11 which are provided in this order counterclockwisely on its inner circumferential side. Four primary transfer rolls are situated between the back-up roll 3 and the tension roll 4. A transfer cleaner 12 for cleaning an external circumferential surface of the intermediate transfer belt 16 is provided so as to contact with the driving roll 11 under pressure, via the intermediate transfer belt 16, on an opposite side of the driving roll 11.

In addition, a secondary transfer roll 5 for transferring a toner image formed on the external circumferential surface of the intermediate transfer belt 16 onto a surface of a recording paper conveyed from a paper tray 7 via a paper path 6 is provided so as to contact with the back-up roll 3 under pressure, on an opposite side of the back-up roll 3 via the intermediate transfer belt 16. On the external circumferential surface of the intermediate transfer belt 16 between the back-up roll 3 and the driving roll 11, a discharging roll (not shown) for discharging the external circumferential surface is provided.

In addition, a paper tray 7 for stocking recording paper is provided at the bottom of the image forming apparatus, and paper can be supplied so as to pass through a pressure-contacting part between the back-up roll 3 and the secondary transfer roll 5 constituting a secondary transfer portion from the paper tray 7 via a paper path 6. A recording paper which has passed through this pressure-contacting part can be conveyed by a conveying means (not shown) so as to pass through a pressure-contacting part of a pair of fixing rolls 2 and, finally, can be ejected outside of the image forming apparatus.

Next, an image forming method using the image forming apparatus of FIG. 1 will be explained. A toner image is formed at every developing unit, and the surfaces of the photoreceptors 9 rotating counter-clockwise are uniformly electrified with electrifying rolls 13, after which latent images are formed on the surfaces of the electrified photoreceptors 9 with a laser-generating device 8 (exposing device), and then the latent images are developed with a developer supplied from the developing devices 15 to form toner images, and the toner images brought to a pressure-contacting part between the primary transfer rolls 10 and the photoreceptors 9 are transferred onto the external circumferential surface of the intermediate transfer belt 16 rotating in the direction of arrow E. Toner and refuse adhered to the surface of the photoreceptors 9 after transfer of the toner images are cleaned with photoreceptor cleaners 14, ready for formation of the next toner image.

Toner images of each color developed at every developing unit are successively superimposed on the external circumferential surface of the intermediate transfer belt 16 so as to correspond to image information, and are delivered thus to the secondary transfer portion where they are transferred onto a surface of a recording paper conveyed from paper tray 7 via paper path 6, with the secondary transfer roll 5. A recording paper onto which a toner image has been transferred is further fixed by heating under pressure upon passing through a pressure-contacting part of the pair of fixing rolls 2 constituting a fixing portion and, after formation of an image on a recording medium surface, it is discharged outside the image forming apparatus.

An intermediate transfer belt which has passed through a secondary transfer portion proceeds further in the direction of arrow E, the external circumferential surface thereof is electricity-removed with a discharging roll (not shown), and the external circumferential surface is cleaned with a transfer cleaner 12, ready for transfer of a next toner image.

Figure 2:
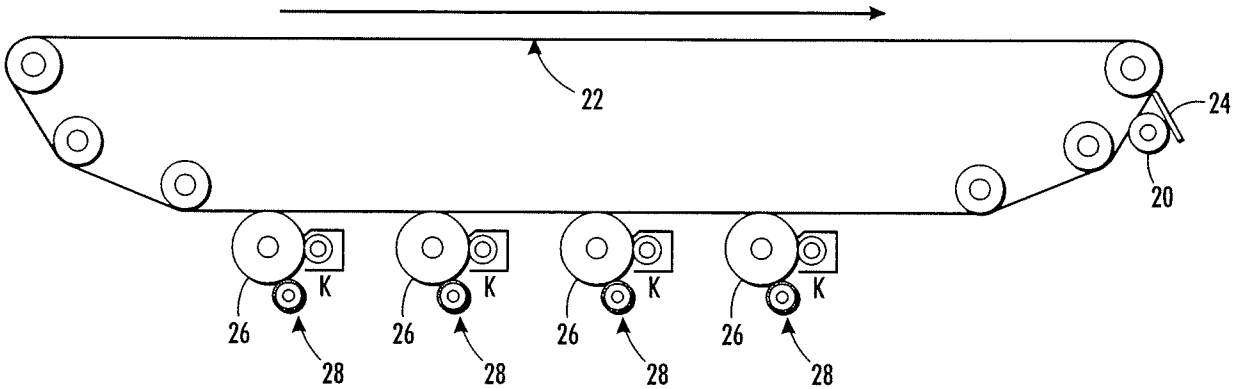
FIG. 2 is a schematic view showing a portion of an image forming apparatus according to the present embodiments.

FIG. 2 is an exemplary embodiment of a portion of an image forming apparatus according to the present embodiments. As shown, the delivery member 20 is placed in contact with the intermediate transfer belt 22 in the post-cleaning position after the intermediate transfer belt cleaning unit 24, such as a blade. The intermediate transfer belt cleaning unit is disposed in contact with the surface of the intermediate transfer belt for cleaning off residual toner and functional material from the intermediate transfer belt. Instead of requiring a separate delivery member for each of the photoreceptors 26 in the CRU 28, the single delivery member 20 supplies the functional material to the intermediate transfer belt 22 which in turn delivers a thin layer of the functional material to the surface of each of the photoreceptors 26.

In further embodiments, there is provided a method for controlled delivery of functional materials onto the surface of a photoreceptor by continuous delivery of the functional material to provide an ultra thin layer of barrier against moisture and surface contaminants and improve xerographic performance in high humidity conditions (A-zone: 28° C., 85% RH). From prior mechanistic studies, it has been demonstrated that A-zone deletion is caused by a number of occurrences, including, high energy charging which results in the formation of hydrophilic chemical species (e.g., —OH, —COON) on the photoreceptor surface, water being physically absorbed on the hydrophilic photoreceptor surface in humid environment, and an increase in the surface conductivity of the photoreceptor due to the absorbed water layer and toner contaminants. Thus, to address these issues, the present embodiments disclose a controlled delivery of an ultra thin layer of functional materials such as hydrophobic material that can be applied directly to the intermediate transfer belt continuously, which in turn delivers the functional materials to one or more photoreceptors or imaging members to prevent A-zone deletion for low wear photoreceptors.

In embodiments, a functional material is continuously delivered on the photoreceptor to form an ultra thin layer of lubricant to protect machine subsystem components, through reducing friction between the cleaning blade and the photoreceptor surface or at the contact interface between the photoreceptor surface and other relevant components. This lubricant further reduces the resultant torque and vibration so that the actuator and involved transmission mechanisms can move the photoreceptor or other relevant components in a smoother way. Therefore, the lubricant improves the printed image quality, which may be deteriorated due to aforementioned reasons, and further protects these components and extends their service life.

The delivery member may comprise a supplying unit containing one or more functional materials to directly provide the functional materials to the intermediate transfer belt. For instance, the functional materials by the supplying unit may be stored in and delivered by a reservoir, polymeric matrix, porous foam, membrane, fabrics or the likes. In further embodiments, the delivery member comprises a delivery member such as a delivery roll for providing the functional materials to the intermediate transfer belt, which in return deliver the functional materials onto the surface of the one or more imaging members downstream from the delivery member.

Figure 3:
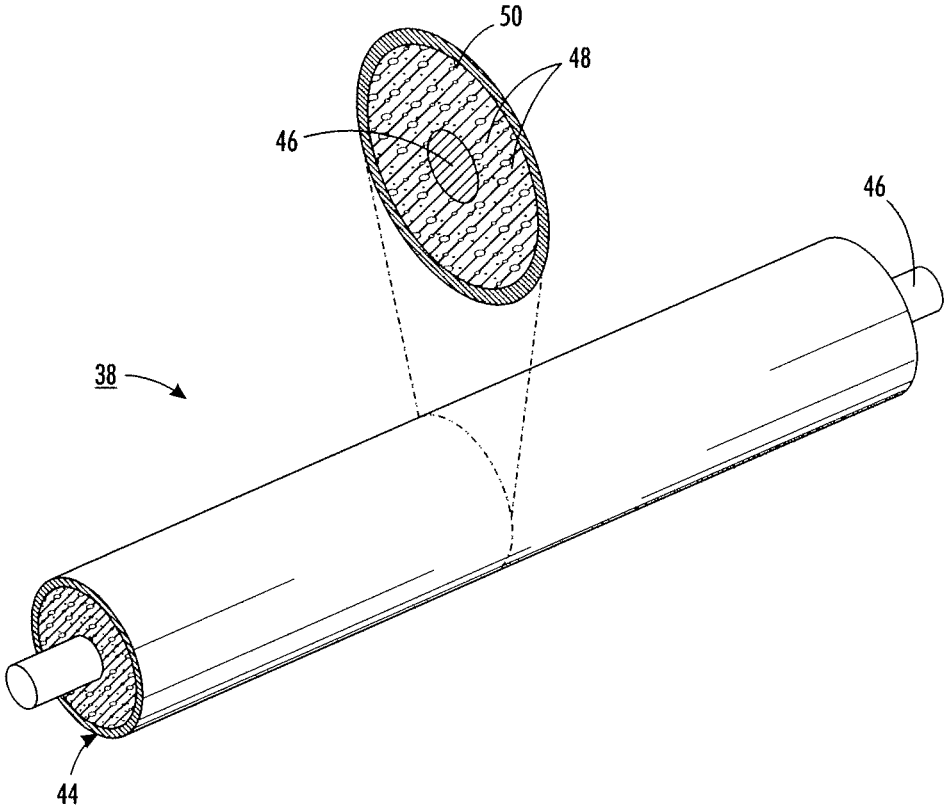
FIG. 3 is a cross-sectional view of a delivery member according to the present embodiments.
Figure 4:
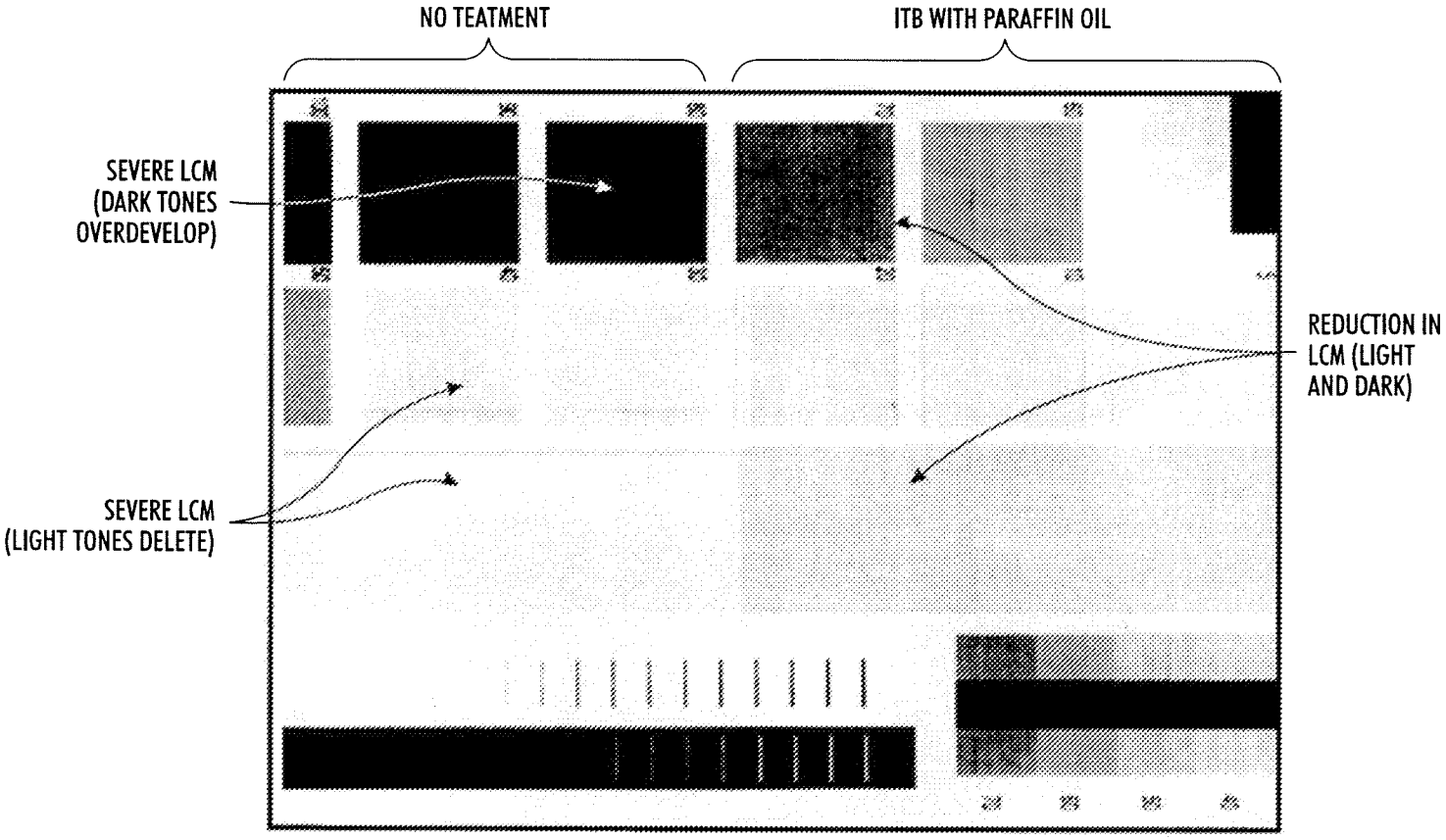
FIG. 4 is a print test demonstrating A-zone deletion and torque results of prints made with the image forming apparatus according to the present embodiments as compared to those made with a control system (without use of delivery member with the functional materials).

FIG. 3 illustrates the delivery member 38 according to the present embodiments, and a cross-section thereof. The delivery member 38 comprises an elastomeric matrix 44 disposed around a support member 46. In embodiments, the support member 46 is a stainless steel rod. The support member can further comprise a material selected from the group consisting of a metal, plastics, ceramic, and mixtures thereof. The diameter of the support member and the thickness of the elastomeric matrix may be varied depending on the application needs. In specific embodiments, the support member has a diameter of, for example, from about 3 mm to about 10 mm. In specific embodiments, the elastomeric matrix has a thickness of, for example, from about 20 μm to about 20 mm. In embodiments, the elastomeric matrix 44 may comprise hydrophobic functional materials 48 retained within a polymer matrix 50 such as a cross-linked silicone which forms a matrix that facilitates retainment of the functional materials.

In other embodiments, the functional material is integrated into the composition of the delivery member 38 and thus eliminates the need for a separate supply of materials within the system or the need to constantly reapplying the materials to the deliver member. In such embodiments, the delivery member 36 is both the reservoir and distributor of the functional material. In addition, the delivery members fabricated according to the present embodiments have shown to contain sufficient quantities of the functional material to continuously supply an ultra thin layer of the functional material to the surface of the photoreceptor.

In embodiments, the functional material can be an organic or inorganic compound, oligomer or polymer, or a mixture thereof. The functional materials may be in the form of liquid, wax, or gel, and a mixture thereof. The functional material may also be selected from the group consisting of a lubricant material, a hydrophobic material, an oleophobic material, an amphiphilic material, and mixtures thereof. Illustrative examples of functional materials may include, for example, a liquid material selected from the group consisting of hydrocarbons, fluorocarbons, mineral oil, synthetic oil, natural oil, and mixtures thereof. The functional materials may further contain a functional group that facilitates adsorption of the functional materials on the photoreceptor surface, and optionally a reactive group that can chemically modify the photoreceptor surface. For examples, the functional materials may comprise paraffinic compound, alkyl alkoxy-silanes, or the mixture thereof. In embodiments, the polymer matrix be comprised of a polymer selected from the group consisting of silicones, polyurethanes, polyesters, fluoro-silicones, polyolefin, fluoroelastomers, synthetic rubber, natural rubber, and mixtures thereof.

In a specific embodiment, the elastomeric matrix 44 is composed of paraffin-impregnated silicone cast around the support member 46. The paraffin-impregnated silicone is prepared by mixing paraffin into a cross-linkable polydimethylsiloxane (PDMS) and then casting the mixture onto the support member 46 by use of a mold. Thereafter, the elastomeric matrix 44 is cured. After curing, the PDMS coated rod is extracted from the mold and may be further impregnated by immersion in a functional material, such as paraffin. In embodiments, the liquid cross-linkable PDMS is prepared from a two-component system, namely, a base agent and a curing agent. In further embodiments, the base agent and curing agent are present in a weight ratio of from about 50:1 to 2:1, or from about 20:1 to about 5:1. In embodiments, the functional material can be incorporated into the polymer matrix at a weight ratio of up to about 1:1, or from about 1:10 to about 1:2

The delivery member may be presented in a roll or have other configurations such as a web. The thickness of elastic materials may be varied, for example, from about 20 μm to about 20 mm, or from about 50 μm to about 10 mm. The delivery member may have a surface pattern comprising indentations or protrusions that have a shape selected from the group consisting of circles, rods, ovals, squares, triangles, polygons, and mixtures thereof.

The diffusion rate of the functional material in the matrix of the elastic composition of the delivery member helps control the delivery rate of the functional material. Consequently, the delivery material forms an outer layer on a Nan-scale or molecular level, providing both an economical method and avoiding contamination from excess functional materials on the photoreceptor and charging member. In embodiments, the functional material may be applied directly to the imaging layer in place of the overcoat layer. In embodiments, the amount of functional material delivered onto the photoreceptor surface should be sufficient to retain the photoreceptor performance properties. The functional material can be present on the photoreceptor surface at various amount, for example, at a molecular level, or amount of from about 0.5 nanogram/$cm^2$ to about 500 nanograms/$cm^2$, or from about 1 nanogram/$cm^2$ to about 100 nanogram/$cm^2$. The present embodiments provide a photoreceptor that exhibits both reduced wear rate and reduced ghosting as compared to a photoreceptor without the outer layer.

Various exemplary embodiments encompassed herein include a method of imaging which includes generating an electrostatic latent image on an imaging member, developing a latent image, and transferring the developed electrostatic image to a suitable substrate.

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

EXAMPLES

The example set forth herein below and is illustrative of different compositions and conditions that can be used in practicing the present embodiments. All proportions are by weight unless otherwise indicated. It will be apparent, however, that the embodiments can be practiced with many types of compositions and can have many different uses in accordance with the disclosure above and as pointed out hereinafter.

Example 1

Fabrication of Delivery Members

A crosslinkable polydimethylsiloxane (PDMS) base and curing agent (Sylgard 184 , Dow Corning) were mixed together in a 10:1 ratio by mass. The components were stirred together. To this mixture was added paraffin oil in a ratio of 2:1 PDMS to paraffin oil. The mixture was stirred together until a viscous mixture was obtained. The mixture was injected into a cylindrical mold, and degassed for one hour. The remaining mold was assembled and the PDMS:paraffin mixture was cured in a forced air lab oven at 60° C. for three hours. The delivery roller was extracted from the mold and incorporated into a CRU for print testing.

Example 2

Fabrication of Photoreceptor

The photoreceptor was fabricated in the following manner. A coating solution for an undercoat layer comprising 100 parts of a ziconium compound (trade name: Orgatics ZC540), 10 parts of a silane compound (trade name: A110, manufactured by Nippon Unicar Co., Ltd), 400 parts of isopropanol solution and 200 parts of butanol was prepared. The coating solution was applied onto a 30-mm cylindrical aluminum (Al) substrate subjected to honing treatment by dip coating, and dried by heating at 150° C. for 10 minutes to form an undercoat layer having a film thickness of 0.1 micrometer.

A 0.5 micron thick charge generating layer was subsequently dip coated on top of the undercoat layer from a dispersion of Type V hydroxygallium phthalocyanine (12 parts), alkylhydroxy gallium phthalocyanine (3 parts), and a vinyl chloride/vinyl acetate copolymer, VMCH (Mn=27,000, about 86 weight percent of vinyl chloride, about 13 weight percent of vinyl acetate and about 1 weight percent of maleic acid) available from Dow Chemical (10 parts), in 475 parts of n-butylacetate.

Subsequently, a 20 μm thick charge transport layer (CTL) was dip coated on top of the charge generating layer from a solution of N,N'-diphenyl-N,N'-bis(3-methylphenyl)-1,1'-biphenyl-4,4'-diamine (82.3 parts), 2.1 parts of 2,6-di-tert-butyl-4-methylphenol (BHT) from Aldrich and a polycarbonate, PCZ-400 [poly(4,4'-dihydroxy-diphenyl-1-1-cyclohexane), $M_w$=40,000] available from Mitsubishi Gas Chemical Company, Ltd. (123.5 parts) in a mixture of 546 parts of tetrahydrofuran (THF) and 234 parts of monochlorobenzene. The CTL was dried at 115° C. for 60 minutes.

An overcoat coating solution was prepared from a mixture of N,N,N',N'-tetrakis-[(4-hydroxymethyl)phenyl]-biphenyl-4,4'-diamine (3.22 g parts), N,N'-diphenyl-N,N'-bis-(3-hydroxyphenyl)-biphenyl-4,4'-diamine (7.98 g parts), melamine-formaldehyde resin (2.10 parts), a silicone leveling agent (0.5 parts), an anti-oxidant (0.4 part), and an acid catalyst (0.65 part) in a solvent of 1-methoxy-2-propanol (40.3 parts). The mixture was mixed on a rolling wave rotator for 10 min and then heated at 50° C. for 65 min until a homogenous solution resulted, then cooled to room temperature. After filtering with a 1-μm PTFE filter, the solution was applied onto the photoreceptor surface and more specifically onto the charge transport layer using cup coating technique, followed by thermal curing at 155° C. for 40 minutes to form an overcoat layer having a film thickness of 6 μm.

Example 3

Fabrication of Image Forming Apparatus

Xerox WorkCentre 7435 Printer was modified by placing the delivery member (delivery roll) of Example 1 against half of the intermediate transfer belt at the post-cleaning position after the intermediate transfer belt blade. A low wear photoreceptor as fabricated in Example 2 was placed in the photoreceptor station Black (K). In this manner, the delivery member applied first a thin layer of paraffin onto the intermediate transfer belt, which in turn applied the paraffin onto the surface of photoreceptor as it rotated.

Evaluation and Testing Results

The imaging apparatus as assembled in Example 3 was placed in Xerox WorkCentre 7435 printer. Print test was conducted in a stressful environment (A-zone: 28° C., 85% RH) to evaluate image quality, specifically deletion.

The use of the functional materials demonstrated elimination of print defects known as "image deletion" under high-humidity ambient conditions and printer motor failure due to high friction between photoreceptor drum and cleaning blade. In FIG. 3, a print test demonstrates significant reduction in image deletion when the functional material, for example, paraffin oil, is applied in a thin layer to the intermediate transfer belt as compared to a control with no treatment. FIG. 3 also demonstrates no fault codes for motor failure (due to high friction between photoreceptor drum and cleaning blade) when the functional material, for example, paraffin oil, is applied in a thin layer to the intermediate transfer belt as compared to the control.

The testing results illustrated herein demonstrate that the delivery roll can deliver a layer of paraffin to one or more photoreceptors through the intermediate transfer belt. The applied paraffin as functional material effectively improves the image quality for overcoated photoreceptors, and helps improve interaction between the photoreceptors and cleaning blade. In practical applications, the delivery roll should cover the full length of the intermediate transfer belt, so that the paraffin functional material can be applied onto the full area of the photoreceptor.

In summary, the present embodiments describe a method and apparatus for delivering a continuous supply of hydrophobic functional material that represents a breakthrough approach toward the goal of a long life photoreceptors by substantially reducing torque and image defects. By applying the functional material to the intermediate transfer belt, the method and apparatus of the present embodiments need only a single delivery unit or member for delivering the functional materials to one or more imaging members. Moreover, in this manner, the delivery unit or member is not limited in size and can provide sufficient functional material for the life of the image forming apparatus.

All the patents and applications referred to herein are hereby specifically, and totally incorporated herein by reference in their entirety in the instant specification.

It will be appreciated that several of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. An image forming apparatus comprising:

a) one or more imaging members comprising:
  a support substrate, and
  one or more photoconductive layers disposed on the substrate;

b) an intermediate transfer belt disposed in contact with the surface of the one or more imaging members; and c) a delivery unit disposed in contact with a surface of the intermediate transfer belt, wherein the delivery unit applies a first layer of a lubricant material to the surface of the intermediate transfer belt and the intermediate transfer belt in turn applies a second layer of the lubricant material onto the surface of the one or more imaging members, wherein the lubricant material is present on the surface of the one or more imaging members in an amount of from about 0.5 nanogram/$cm^2$ to about 500 nanograms/$cm^2$;

wherein the delivery unit comprises a delivery member comprising:

a support member, and an elastomeric layer disposed on the support member, wherein the elastomeric layer is comprised of a polymer matrix containing one or more lubricant materials dispersed within the polymer matrix, further wherein the lubricant material is incorporated into the polymer matrix at a weight ratio of from about 1:10 to about 1:2.

2. The image forming apparatus of claim 1, wherein the delivery unit comprises a supplying unit containing one or more lubricant materials.

3. The image forming apparatus of claim 2, wherein the supplying unit is selected from the group consisting of reservoir, polymeric matrix, porous foam, membrane, and fabrics.

4. The image forming apparatus of claim 1, wherein the polymer matrix comprises a cross-linked polymer selected from the group consisting of silicones, polyurethanes, polyesters, fluoro-silicones, polyolefin, fluoroelastomers, synthetic rubber, natural rubber, and mixtures thereof.

5. The image forming apparatus of claim 1, wherein the elastomeric layer comprises a cross-linked silicone polymer.

6. The image forming apparatus of claim 1, wherein the support member comprises a material selected from the group consisting of a metal, plastics, ceramic, and mixtures thereof.

7. The image forming apparatus of claim 1, wherein the amount of the lubricant material delivered onto the surface of the imaging member is controlled by the diffusion rate of the lubricant material in the elastomeric layer.

8. The image forming apparatus of claim 1, wherein the lubricant material comprises a liquid material selected from the group consisting of hydrocarbons, fluorocarbons, mineral oil, synthetic oil, natural oil, and mixtures thereof.

9. The image forming apparatus of claim 1, wherein the lubricant material comprises paraffin oil.

10. The image forming apparatus of claim 1, wherein the delivery member has a smooth surface or a patterned surface.

11. The image forming apparatus of claim 10, wherein the patterned surface comprises indentations or protrusions that have a shape selected from the group consisting of circles, rods, ovals, squares, triangles, polygons, and mixtures thereof.

12. The image forming apparatus of claim 1, wherein the polymer matrix comprises polydimethylsiloxane.

13. The image forming apparatus of claim 12, wherein the lubricant material comprises paraffin oil.

14. An image forming apparatus comprising:

a) one or more imaging members comprising:
  a support substrate, and
  one or more photoconductive layers disposed on the substrate;

b) an intermediate transfer belt disposed in contact with the surface of the one or more imaging members;

c) an intermediate transfer belt cleaning unit disposed in contact with the surface of the intermediate transfer belt; and d) a delivery unit disposed in contact with a surface of the intermediate transfer belt downstream from the intermediate transfer belt cleaning unit, wherein the delivery unit applies a first layer of a lubricant material to the surface of the intermediate transfer belt and the intermediate transfer belt in turn applies a second layer of the lubricant material onto the surface of the one or more imaging members, wherein the lubricant material is present on the surface of the one or more imaging members in an amount of from about 0.5 nanogram/$cm^2$ to about 500 nanograms/$cm^2$;

wherein the delivery unit comprises a delivery member comprising:

a support member, and an elastomeric layer disposed on the support member, wherein the elastomeric layer is comprised of a polymer matrix containing one or more lubricant materials dispersed within the polymer matrix, further wherein the lubricant material is incorporated into the polymer matrix at a weight ratio of from about 1:10 to about 1:2.

15. The image forming apparatus of claim 14, wherein the intermediate transfer belt cleaning unit is a blade.

16. The image forming apparatus of claim 14, wherein the delivery unit comprises a delivery member comprising:

a support member, and an elastomeric layer disposed on the support member, wherein the elastomeric layer comprises a cross-linked silicone polymer and a paraffin compound dispersed within the polymer.

17. A method for reducing printing defects in an image forming apparatus comprising:

providing a delivery unit containing functional material in an image forming apparatus, the image forming apparatus comprising a) one or more imaging members comprising a support substrate, and one or more photoconductive layers disposed on the substrate;

b) an intermediate transfer belt disposed in contact with the surface of the one or more imaging members, and c) the delivery unit disposed in contact with a surface of the intermediate transfer belt; wherein the delivery unit comprises a delivery member comprising:

a support member, and an elastomeric layer disposed on the support member, wherein the elastomeric layer is comprised of a polymer matrix containing one or more lubricant materials dispersed within the polymer matrix, further wherein the one or more lubricant materials are incorporated into the polymer matrix at a weight ratio of from about 1:10 to about 1:2;

contacting the intermediate transfer belt with the delivery unit to apply a layer of the one or more lubricant materials to the surface of the intermediate transfer belt; and contacting the one or more imaging members with the intermediate transfer belt to deliver the one or more lubricant materials to the surface of the one or more imaging members, wherein the one or more lubricant materials are present on the surface of the one or more imaging members in an amount of from about 0.5 nanogram/$cm^2$ to about 500 nanograms/$cm^2$.

18. The method of claim 17, wherein the image forming apparatus further comprises an intermediate transfer belt cleaning unit disposed in contact with the surface of the intermediate transfer belt for cleaning off residual toner and lubricant material from the intermediate transfer belt.

19. The method of claim 18, wherein the step of contacting the intermediate transfer belt with the delivery unit to apply the layer of the one or more lubricant materials to the surface of the intermediate transfer belt occurs after the cleaning step.

* * * * *